United States Patent [19]

Bobbola

[11] Patent Number: 4,605,875

[45] Date of Patent: Aug. 12, 1986

[54] PIEZOELECTRIC TRANSDUCER FOR YARN FEELERS, FOR USE ON SPINNING AND WEAVING MACHINES

[75] Inventor: Paolo Bobbola, Vigliano Biellese, Italy

[73] Assignee: Roj Electrotex S.p.A., Biella, Italy

[21] Appl. No.: 658,806

[22] Filed: Oct. 9, 1984

[30] Foreign Application Priority Data

Oct. 7, 1983 [IT] Italy ..... 23198 A/83

[51] Int. Cl.[4] ..... H01L 41/08

[52] U.S. Cl. ..... 310/323; 310/330

[58] Field of Search ..... 310/330–332, 310/321, 323; 139/391

[56] References Cited

U.S. PATENT DOCUMENTS 4,110,654 8/1978 Paul ..... 310/330 X

*Primary Examiner*—Mark O. Budd

*Attorney, Agent, or Firm*—Young & Thompson

[57] ABSTRACT

A piezoelectric transducer for yarn feelers for fitting to spinning and weaving machines and devices, constituted by a single ceramic member incorporating the yarn guide and cemented directly to a ceramic piezoelectric element, the size and shape of said member being chosen such that its resonance frequencies are very different from those of the textile machines and devices to which the yarn feeler is to be fitted.

1 Claim, 8 Drawing Figures

PIEZOELECTRIC TRANSDUCER FOR YARN FEELERS, FOR USE ON SPINNING AND WEAVING MACHINES

BACKGROUND OF THE INVENTION

On various spinning and weaving machines it is known to use devices for sensing the flow of yarn to be woven (yarn feelers), many of these devices being piezoelectric devices.

In constructing any piezoelectric yarn feeler, the transducer element for sensing the movement of said yarn is very important.

In this respect, this transducer element generates the electrical signals produced by the movement of the yarn over said transducer, and also generates the electrical disturbance signals induced by the environment. Each transducer must therefore be constructed with the highest possible ratio or signals produced by the yarn flow to signals produced by "environmental disturbance", the term "environmental disturbance" indicating any electrical signal generated by the piezoelectric transducer which is other than that produced by the movement of the yarn.

The choice of the shape and component materials of a transducer of this kind is therefore the determining factor in improving the signal/disturbance ratio for each application.

The practical embodiments used up to the present time for transducers for yarn feelers of spinning and weaving machines, of which FIG. 1 of the accompanying drawing is a fairly common example, are characterised in that the vibrations produced by the yarn f on a ceramic yarn guide 1 of the feeler are transmitted by a metal foil 2 to the ceramic piezoelectric element 3, the yarn guide 1 and ceramic piezoelectric element 3 being rigidly cemented to the foil 2.

The coefficient of transmission of the vibration from the yarn guide 1 to the ceramic element 3 therefore depends on the mechanical coupling between the component parts of the transducer and on the type of adhesive used, and gives rise to large losses with regard to the signal produced by the flow of the yarn.

SUMMARY OF THE INVENTION

The present invention proposes to improve this situation by providing a piezoelectric transducer for yarn feelers of spinning and weaving machines and devices which considerably reduces flow signal losses due to the mechanical connection between its parts, and leads to a substantial increase in the signal/noise ratio compared with feelers used up to the present time.

The transducer for yarn feelers according to the present invention is characterised essentially by being constituted by a single ceramic member incorporating the yarn guide and cemented directly to a ceramic peizoelectric element, the size and shape of said member being chosen such that its resonance frequencies are very different from those of the textile machines and devices to which the yarn guide is to be fitted.

The invention also relates to yarn feelers using the aforesaid transducer. In this yarn feeler, the ceramic member of said transducer incorporates the yarn guide, which projects from the body of the yarn feeler.

BRIEF DESCRIPTION OF THE DRAWINGS

The invention is described in greater detail hereinafter by way of example with reference to one embodiment thereof illustrated on the accompanying drawing in which.

DESCRIPTION OF THE PREFERRED EMBODIMENTS

Figure 2:
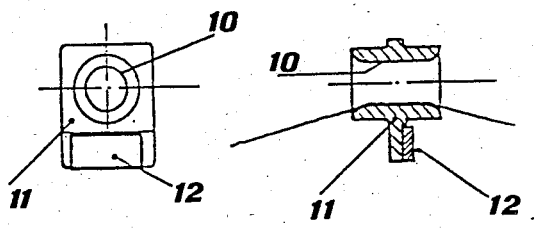
FIG. 2 is a cross-section and full view of a tranducer according to the invention, suitable for yarn feelers of weaving looms.

As can be seen from FIG. 2, the transducer according to the invention is constituted by a single ceramic member 11 incorporating the yarn guide 10 and cemented directly to a ceramic piezoelectric element 12, the size and shape of the member 11 being chosen such that its resonance frequencies are very different from the (relatively low) resonance frequencies of the textile machines to which the yarn feeler device is fitted.

Figure 3:
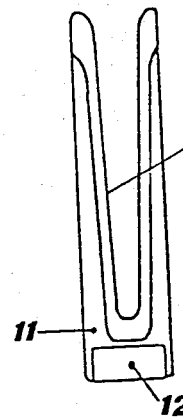
FIGS. 3, 4 and 5 show transducers according to the invention suitable for carding machines, warping machines and spinning machines respectively.
Figure 4:
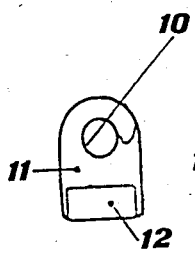
Figure 5:
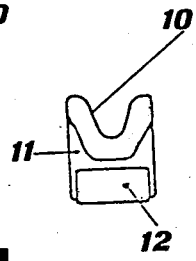

The transducers of FIGS. 3, 4 and 5 are of different shapes from the transducer of FIG. 2, so as to adapt them as effectively as possible to their use in carding machines, warping machines and spinning machines respectively, but they are all formed in accordance with the same principle, comprising a single ceramic member 11 incorporating the yarn guide 10 and cemented directly to a ceramic piezoelectric element 12, and having their resonance frequency very different from that of the machines to which they are fitted.

Figure 6:
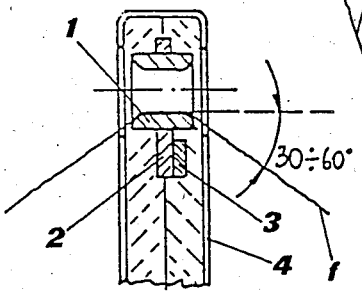
FIGS. 6, 7 and 8 show respectively two yarn feeler devices of the known art and a yarn feeler device for weaving looms formed by the transducer according to the invention.
Figure 7:
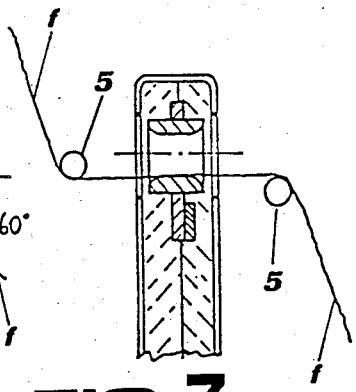
Figure 8:
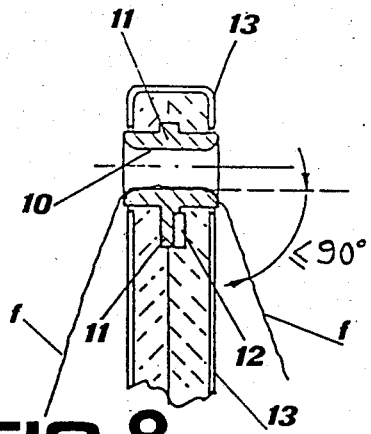

FIGS. 6 to 8 show certain merits of the transducer according to the invention with reference to its application to yarn feelers for weaving looms.

In weaving looms, the yarn feelers or devices for sensing the weft flow are constituted by an electromechanical part represented by one or more piezoelectric transducers, and an electronic amplification and filtering part arranged to provide an output signal which indicates whether the yarn being monitored is flowing or is still.

Figure 1:
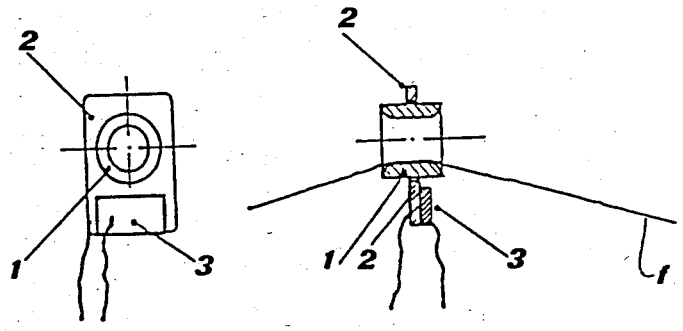
FIG. 1 (PRIOR ART)
FIG. 1 shows the transducer of the known art described heretofore in cross-sectional and full views.

The weft flow sensors constructed up to the present time use transducers of the type shown in FIG. 1, for which however the high noise level of the weaving loom imposes a limit on the dimensions of the yarn guide 1 in order to minimise the surface exposed to the environmental noise. Thus in order to attain an acceptable signal/disturbance ratio, the yarn guide must always be contained in a protection or masking structure 4 which normally constitutes the casing of said sensor (FIG. 6). Thus serious limits are placed on the possible paths which the weft yarn f can take, in that it must not rub against the sensor casing 4 (noramlly of metal), otherwise its component fibres can become damaged and the quality of the fabric can suffer.

This is normally obviated by inserting one or more ceramic yarn deviators 5 at the inlet and/or outlet of the sensor (FIG. 7).

This clearly leads not only to a notable increase in the overall cost of the monitoring device, but also and in particular to a greater stressing of the weft yarn, which is subjected to a more deviated path and increased rubbing, so that the tension in the yarn leaving the yarn feeler is much greater than the tension at its inlet. This is an unacceptable condition with fine, delicate yarns because it leads to an increase in weft breakage and a consequent fall in the weaving machine yield.

With the transducer according to the invention all these problems are overcome. In this respect, as can be seen from FIG. 8 it is possible in this case to make the transducer's ceramic member 11 which incorporates the yarn guide 10 project from the sensor casing 13, while maintaining an excellent signal/noise ratio even under the most severe operating conditions. No rubbing of the weft yarn against the sensor casing is possible, all possible inlet and/or outlet angles (up to 90° as shown in FIG. 8) being acceptable to the sensor in practice without it being necessary to use any yarn deviator.

Other embodiments of the invention are possible, and these together with all modifications of those described and illustrated fall within the scope of the present invention.

I claim:

1. A yarn feeler comprising a casing, and within the casing a piezoelectric transducer comprising a ceramic member having a yarn guide formed from said ceramic member and having a hole therethrough, said ceramic member being cemented direclty to a ceramic piezoelectric element within the casing, the size and shape of said ceramic member being such that its resonance frequencies are substantially different from those of the textile machines and devices to which the transducer is to be fitted, said yarn guide projecting from opposite sides of said casing.

* * * * *